US011377244B2

(12) United States Patent
Boriani et al.

(10) Patent No.: US 11,377,244 B2
(45) Date of Patent: Jul. 5, 2022

(54) APPARATUS FOR PACKING PRODUCTS IN CARTONS

(71) Applicant: Azionaria Costruzioni Macchine Automatiche A.C.M.A. S.p.A., Bologna (IT)

(72) Inventors: Luca Boriani, Bologna (IT); Maria Livia Melchionda, Bologna (IT); Massimo Scrivani, Casteggio (IT)

(73) Assignee: AZIONARIA COSTRUZIONI MACCHINE AUTOMATICHE A.C.M.A, Bologna (IT)

( * ) Notice: Subject to any disclaimer, the term of this patent is extended or adjusted under 35 U.S.C. 154(b) by 325 days.

(21) Appl. No.: 16/629,890

(22) PCT Filed: Aug. 3, 2018

(86) PCT No.: PCT/IB2018/055850
§ 371 (c)(1),
(2) Date: Jan. 9, 2020

(87) PCT Pub. No.: WO2019/026040
PCT Pub. Date: Feb. 7, 2019

(65) Prior Publication Data

US 2020/0140130 A1 May 7, 2020

(30) Foreign Application Priority Data

Aug. 4, 2017 (IT) ..... 102017000089386

(51) Int. Cl.
*B65B 35/20* (2006.01)
*B65B 57/10* (2006.01)
(Continued)

(52) U.S. Cl.
CPC ..... *B65B 35/205* (2013.01); *B65B 5/04* (2013.01); *B65B 57/02* (2013.01); *B65B 57/10* (2013.01)

(58) Field of Classification Search
CPC ..... B65B 35/305; B65B 35/20; B65B 5/04
(Continued)

(56) References Cited

U.S. PATENT DOCUMENTS 3,935,694 A 2/1976 Langen
4,578,927 A * 4/1986 Scarpa ..... B65B 35/205 53/506

(Continued)

FOREIGN PATENT DOCUMENTS

EP 0765810 A1 4/1997
WO 2008109383 A1 9/2008
WO 2015193758 A1 12/2015

OTHER PUBLICATIONS

Indian Office Action dated Jan. 13, 2022 from counterpart Indian Patent Application No. 202027001492.

(Continued)

*Primary Examiner* — Robert F Long
*Assistant Examiner* — Xavier A Madison
(74) *Attorney, Agent, or Firm* — Shuttleworth & Ingersoll, PLC; Timothy J. Klima

(57) ABSTRACT

This invention relates to an apparatus for packing products in cartons; the apparatus includes a first feed line for feeding cartons, a second feed line for feeding products, a plurality of pushing elements, each of which includes a first carriage configured to run on a first rail defining an active path and a second carriage configured to run on a second rail defining an inactive path; a diverting unit is provided which is configured to divert the pushing elements in transit towards the active path or the inactive path and which includes a first (Continued)

diverting rail and a second diverting rail; also provided are detection means for detecting the presence of the carton and/or of the product and switching means for switching the diverting unit.

5 Claims, 3 Drawing Sheets

(51) Int. Cl.
*B65B 57/02* (2006.01)
*B65B 5/04* (2006.01)

(58) Field of Classification Search
USPC ..... 53/58
See application file for complete search history.

(56) References Cited

U.S. PATENT DOCUMENTS 4,982,556 A * 1/1991 Tisma ..... G07F 17/0092 53/154
5,660,022 A * 8/1997 Lade ..... B65B 35/205 53/566
5,768,854 A * 6/1998 Nannini ..... B65B 35/205 53/506
2008/0209867 A1* 9/2008 Lidington ..... B65B 35/205 53/566
2015/0047295 A1 2/2015 van de Loecht

OTHER PUBLICATIONS

International Search Report dated Oct. 17, 2018 from counterpart PCT App No. PCT/IB2018/055850.

* cited by examiner

APPARATUS FOR PACKING PRODUCTS IN CARTONS

This application is the National Phase of International Application PCT/1B2018/055850 filed Aug. 3, 2018 which designated the U.S.

This application claims priority to Italian Patent Application No. 102017000089386 filed Aug. 4, 2017, which application is incorporated by reference herein.

TECHNICAL FIELD

This invention relates to an apparatus for packing products in cartons.

Specifically, but not exclusively, this invention is advantageously used to pack particularly delicate products such as soap bars, for example.

BACKGROUND ART

In particular, reference is made to apparatuses of the type described in patent publication EP0765810 in the name of this applicant and comprising: a first feed line for feeding cartons, a second feed line for feeding products and synchronized with the first feed line, a plurality of pushing elements movable one after the other in synchrony with the feed lines, a diverting element configured to operate on the pushing elements in transit and switchable between a first position, in which it directs the pushing elements along an active path where a pushing element is driven to push a product into a respective carton, and a second position in which it directs the pushing elements along an inactive path; a sensor is provided to detect error situations regarding the carton or the product on which a certain pushing element has to operate.

Under normal operating conditions, the diverting element of the prior art apparatus is immovable when in the first position.

If the sensor detects an error situation for which it is necessary to direct a certain pushing element along the inactive path—for example, the absence of a carton on the first feed line—the diverting element is driven to move into the second position by specific drive means, consisting for example of a double acting cylinder. The pushing element thus passes through the diverting element and is directed into the inactive path. As soon as the pushing element has passed and before the next pushing element arrives, the diverting element is moved back to the first position by the same drive means. Thus, both the forward and the return movements must be completed within the time interval between the passing of two consecutive pushing elements.

This prior art apparatus has some limitations and disadvantages.

First of all, it packs a reduced number of products per unit time. This is due mainly to the fact that the speed of the forward and return movements of the diverting element must not exceed a certain value on account of the inertia of the respective drive means. Consequently, the pushing elements also pass less frequently and the operating speed of the apparatus as a whole is thus limited.

Secondly, the diverting element undergoes relatively rapid wear because the pushing elements interact with the diverting element by impact. This may also lead to loss of synchrony between the pusher elements and the rest of the apparatus. The diverting element thus requires periodic maintenance.

Moreover, the diverting action performed by the diverting element is imprecise and unreliable and the switch between the first and the second position is the critical event which may lead to malfunctioning of the entire apparatus.

DISCLOSURE OF THE INVENTION

In this context, the technical purpose which forms the basis of this invention is to propose an apparatus for packing products in cartons to overcome the above mentioned disadvantages of the prior art.

More specifically, the aim of this invention is to provide an apparatus for packing product in cartons to improve the efficiency of the packing process.

A further aim of this invention is to reduce the wear rate of the pushing elements so as to increase their durability.

Yet another aim of this invention is to provide an apparatus for packing product in cartons capable of packing a large number of products per unit time.

The technical purpose and aims specified are substantially achieved by an apparatus for packing products in cartons comprising the technical features described in one or more of the appended claims.

In particular, this invention relates to an apparatus for packing products in cartons, comprising:

- a first feed line for feeding cartons,
- a second feed line for feeding products, synchronized with the first feed line in such a way that the products can be inserted into the cartons used to pack them,
- a plurality of pushing elements movable one after the other in synchrony with the feed lines,
- a diverting unit adapted to operate on the pushing elements in transit and switchable between a first configuration, in which the diverting unit directs the pushing elements along an active path where a pushing element is driven to push a product into a respective carton, and a second configuration in which the diverting unit directs the pushing elements along an inactive path,
- detecting means for detecting parameters identifying the presence of the carton and/or of the product on which a certain pushing element must operate, where the detecting means comprise at least one detecting sensor,
- switching means connected to the detecting means and configured to switch the diverting unit to the first configuration or to the second configuration as a function of the identification parameters.

Each pushing element comprises a first carriage configured to run on a first rail defining an active path and a second carriage configured to run on a second rail defining an inactive path.

The diverting unit comprises a first diverting rail and a second diverting rail adapted, respectively, to receive the first carriage of the pushing element in the first configuration and the second carriage of the pushing element in the second configuration. The first diverting rail defines a first stretch of the first rail of the apparatus in the first configuration and the second diverting rail defines a second stretch of the second rail of the apparatus in the second configuration.

Thanks to the presence, for each pushing element, of a first carriage, dedicated to the active path and of a second carriage dedicated to the inactive path, it is possible to manage in a simple and effective manner the feed paths of the pushing elements, by simply switching the diverting unit to the first configuration or to the second configuration.

The dependent claims, which are incorporated herein by reference, correspond to different embodiments of the invention.

BRIEF DESCRIPTION OF THE DRAWINGS

Further features of the invention and its advantages are more apparent in the non-limiting description below, with reference to a preferred but non-exclusive embodiment of an apparatus for packing products in cartons illustrated in the accompanying drawings, in which.

DETAILED DESCRIPTION OF PREFERRED EMBODIMENTS OF THE INVENTION

Figure 1:
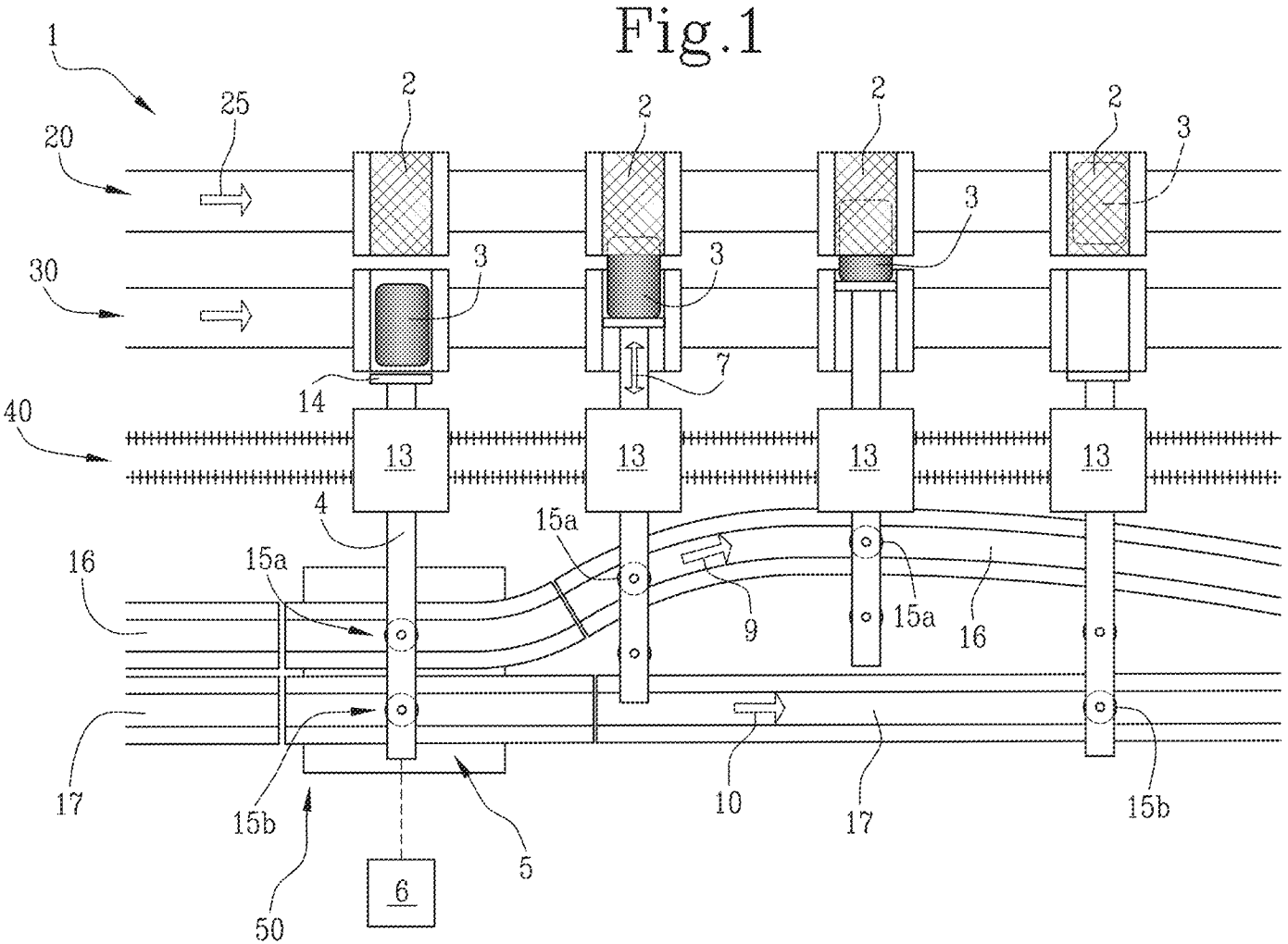
FIG. 1 is a functional diagram of the apparatus for packing products in cartons according to this invention.

With reference to the drawings listed above, the numeral 1 denotes in its entirety an apparatus for packing products 3, consisting, in this specific case, of soap bars, into respective cartons 2.

A first feed line for feeding cartons 2 and a second feed line for feeding soap bars 3, are labelled 20 and 30, respectively. These feed lines are synchronized with each other in such a way that each carton 2 advances in the feed direction indicated by the arrow 25 at a preset speed and with a respective soap bar 3 advancing alongside it.

Figure 2:
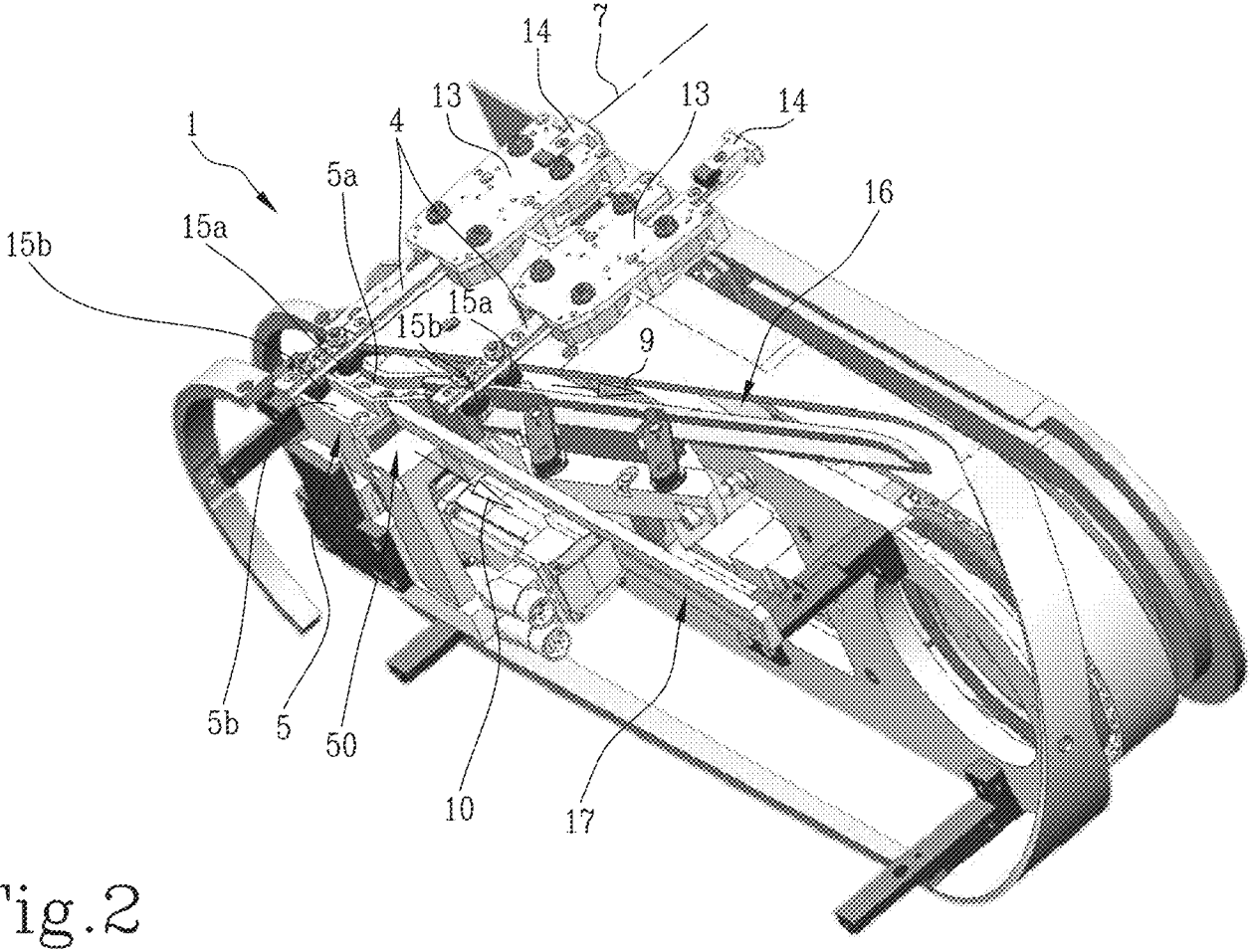
FIG. 2 is a schematic perspective view, with some parts hidden or cut away to better illustrate others, of an embodiment of the apparatus for packing products in cartons according to this invention.
Figure 3:
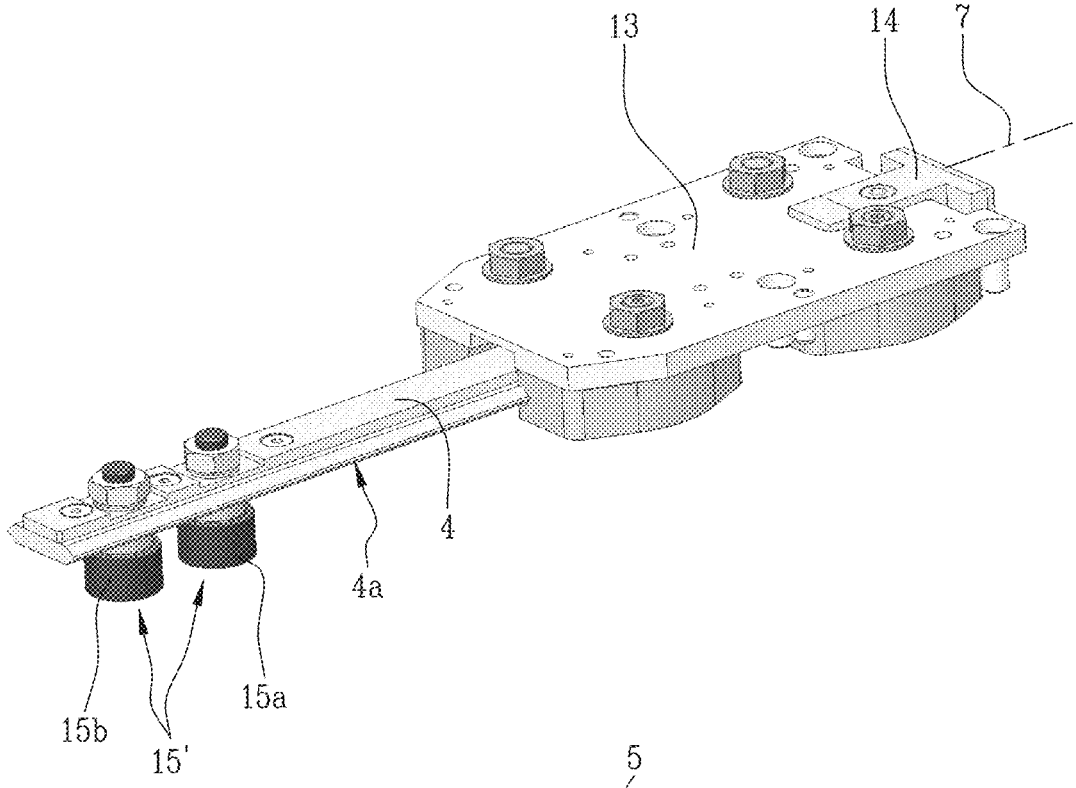
FIG. 3 is a schematic perspective view of a pushing element of the apparatus of FIG. 2.

Also provided is an endless chain conveyor 40 having, connected to it, a plurality of supports 13, spaced from each other at a predetermined, constant spacing. FIGS. 1 and 2 show only some of the supports 13.

The conveyor 40 moves the supports 13 one after the other synchronously with the feed lines 20 and 30 in the feed direction 25. Slidably coupled to each support 13 there is a pushing element 4 which slides in a direction 7 normal to the feed direction 25 of the supports 13 and each pushing element 4 is provided, at one end of it, with a head 14 adapted to interact with a soap bar 3.

Each pushing element 4 is configured to insert a product 3 into a respective carton 2 used to pack it.

At the end of the pushing element 4 opposite to the head 14, the pushing element 4 comprises a first carriage 15*a* and a second carriage 15*b*.

The apparatus 1 also comprises a diverting unit 5 adapted to operate on the pushing elements 4 in transit and switchable between a first configuration, in which the diverting unit 5 directs the pushing elements 4 along an active path 9 where a pushing element 4 is driven to push a product 3 into a respective carton 2, and a second configuration in which the diverting unit 5 directs the pushing elements 4 along an inactive path 10.

The first carriage 15*a* of the pushing element 4 is configured to run on a first rail 16 of the apparatus 1 defining the active path 9 of the pushing element 4, while the second carriage 15*b* is configured to run on a second rail 17 of the apparatus defining the inactive path 10 of the pushing element 4.

The apparatus 1 also comprises detecting means 6, of known type and illustrated only schematically in the drawings, for detecting parameters identifying the presence of the carton 2 and/or of the product 3 on which a certain pushing element 4 must operate, where the detecting means 6 comprise at least one detecting sensor, not illustrated in the accompanying drawings.

The detecting means 6 are configured to preferably detect an error situation along the feed lines 20 and 30 in connection with the carton 2 or the soap bar 3 on which a particular pushing element 4 must operate; such a situation might be, for example, the absence of carton 2 or of a soap bar 3. For the good operation of the apparatus 1, that particular pushing element 4 must be directed along the inactive path 10 on the second rail 17.

The apparatus 1 also comprises switching means 50 connected to the detecting means 6 and configured to switch the diverting unit 5 to the first configuration or to the second configuration as a function of the identification parameters.

The diverting unit 5 comprises a first diverting rail 5*a* and a second diverting rail 5*b* adapted, respectively, to receive the first carriage 15*a* of the pushing element 4 in the first configuration and the second carriage 15*b* of the pushing element 4 in the second configuration.

The first diverting rail 5*a* defines a first stretch of the first rail 16 of the apparatus 1 in the first configuration and the second diverting rail 5*b* defines a second stretch of the second rail 17 of the apparatus 1 in the second configuration.

The diverting unit 5 thus acts as a switching means on the feed path of the pushing elements 4.

In other words, the first rail 16 and the second rail 17 are configured to receive the first carriage 15*a* and the second carriage 15*b*, respectively, and to guide the respective pushing element 4 along an active path 9 or an inactive path 10, respectively.

More specifically, if the pushing element 4 must move into the active path 9, when the pushing element 4 reaches the diverting unit 5, the first carriage 15*a* of the pushing element 4 slides in the first diverting rail 5*a* in the first configuration.

The first rail 16 thus makes the pushing element 4 slide relative to the respective support 13 in such a way that the head 14 interacts with a soap bar 3 in transit on the second feed line 30 to push the soap bar 3 into a respective carton 2 in transit on the first feed line 20.

When it is slidable in the first rail 16, therefore, the first carriage 15*a* allows moving the pushing element 4 along the normal feed direction 7 in such a way as to progressively insert a respective product 3 into a respective carton 2 while the pushing element 4 advances along the feed direction 25.

On the other hand, if the pushing element 4 must move into the inactive path 10, when the pushing element 4 reaches the diverting unit 5, the second carriage 15*b* of the pushing element 4 slides in the second diverting rail 5*b* in the second configuration.

The second rail 17 makes the pushing element 4 slide relative to the respective support 13 in such a way that the head 14 is not moved along the normal feed direction 7 and thus does not interact with the second feed line 30.

The switching means 50 thus allow choosing whether the pushing element 4 must engage the first diverting rail 5*a* by means of the first carriage 15*a* or the second rail 5*b* by means of the second carriage 15*b*.

That way, the pushing element 4, by moving through the first diverting rail 5*a* or the second diverting rail 5*b* follows, respectively, the active path 9, along the first rail 16, or the inactive path 10, along the second rail 17, as a function of the parameters detected by the detecting means 6.

The switching means 50 according to this invention are configured to move the first diverting rail 5*a* into a first, rest configuration, where the first carriage 15*a* of each pushing element 4 cannot slide into the first diverting rail 5*a*, when the second diverting rail 5*b* is moved into the second configuration, and to move the second diverting rail 5*b* into a second, rest configuration, where the second carriage 15*b* of each pushing element 4 cannot slide into the second diverting rail 5*b*, when the first diverting rail 5*a* is moved into the first configuration.

In other terms, only one between the first diverting rail 5*a* and the second diverting rail 5*b* is engaged by each pushing element 4, thereby determining its feed path (active 9 or inactive 10).

The presence of two diverting rails 5*a*, 5*b*, suitably switchable between the first and second configurations by the switching means 50, allows advancing the pushing elements 4 quickly and smoothly by simply selecting which of the two must come into operation while the other is in the rest configuration so as not to interfere with the advancing of the respective carriage 15*a*, 15*b*.

The first rail 16*b* is shaped in such a way as to cause the pushing element 4 to retract in the direction opposite to that indicated by the arrow 7 after pushing the soap bar 3 into the respective carton 2.

Let us now suppose the detecting means 6 detect an error situation caused, for example, by the absence of a carton 2 on the first feed line 20.

This is a situation where the pushing element 4 which was to have pushed a soap bar 3 into the missing carton 2 must be directed into the inactive path 10, that is, onto the second rail 17.

In use, the detecting means 6 send a signal to the switching means 50, which immediately set the diverting unit 5 to the second configuration. That way, upon the transit of the pushing element 4 corresponding to the product 3 which must not be pushed, for example because the respective carton 2 is missing, the second carriage 15*b* of the pushing element 4 engages the second diverting rail 5*b* of the diverting unit 5, so that on leaving the diverting unit 5, the pushing element 4 proceeds on the inactive path 10 along the second rail 17.

Concurrently with the step just described, the first diverting rail 5*a* is in a rest configuration and is not therefore engaged by the first carriage 15*a* of the pushing element 4.

Preferably, the diverting unit 5 remains fixed in the second configuration as long as the detecting means 6 detect errors also in connection with the pushing elements 4 which follow. When the detecting means 6 no longer detect errors regarding the products 3 or the cartons 2, the detecting means 6 send a signal to the switching means 50 to indicate that the errors have ended and the switching means 50 can thus switch the diverting unit 5 to the first configuration so that the pushing elements 4 can proceed along the active path 9 to pack the products 3 in the cartons 2.

According to this invention, the switching means 50 are configured to switch the diverting unit 5 between the first and the second configuration in synchrony with the transit of the pushing elements 4.

Preferably, the first diverting rail 5*a* and the second diverting rail 5*b* are reciprocatingly movable towards and away from the first rail 16 and the second rail 17 of the apparatus 1 in a normal direction, preferably vertical, as indicated by the arrows 8.

The movement in the normal direction allows compensating for any errors, even macroscopic errors, in timing and/or positioning the pushing elements 4 with the diverting unit 5.

The movement in the normal direction also allows considerably reducing the time needed to position the first diverting rail 5*a* and the second diverting rail 5*b*, making it possible to increase the speed of the machine without creating problems of wear and impact of the moving mechanical parts.

Even if switching occurs at the wrong time, when the pushing element 4 is passing through the first diverting rail 5*a* or the second diverting rail 5*b*, there would not in any case be any impact in the direction of motion of the pushing element 4, an impact which would otherwise upset the operation of the apparatus 1.

Preferably, the first carriage 15*a* and the second carriage 15*b* are disposed on an underside 4 of the pushing element 4 and are defined by a first roller 15*a* and a second roller 15*b*, respectively, each roller 15*a* and 15*b* having an increased compliance sliding portion 15' located at a distal position relative to the underside 4*a* of the pushing element 4 and adapted to slide in the first rail 16 and in the second rail 17, respectively. The increased compliance sliding portion 15' allows damping the impact of the first and the second diverting rail 5*a*, 5*b* against the respective roller 15*a*, 15*b*, in particular in the presence of errors of synchronization between the transit of the rollers 15 and the reciprocating motion of the diverting unit 5.

Preferably, the switching means 50 comprise a rocker 51 which rotates alternately about an axis of rotation 52. The first diverting rail 5*a* is associated with a first end 51*a* of the rocker 51 and the second diverting rail 5*b* is associated with a second free end 51*b* of the rocker 51.

In use, rotation of the rocker 51 causes the diverting unit 5 to switch between the first configuration and the second configuration, alternately translating the first diverting rail 5*a* and the second diverting rail 5*b* along the normal direction 8.

Figure 4:
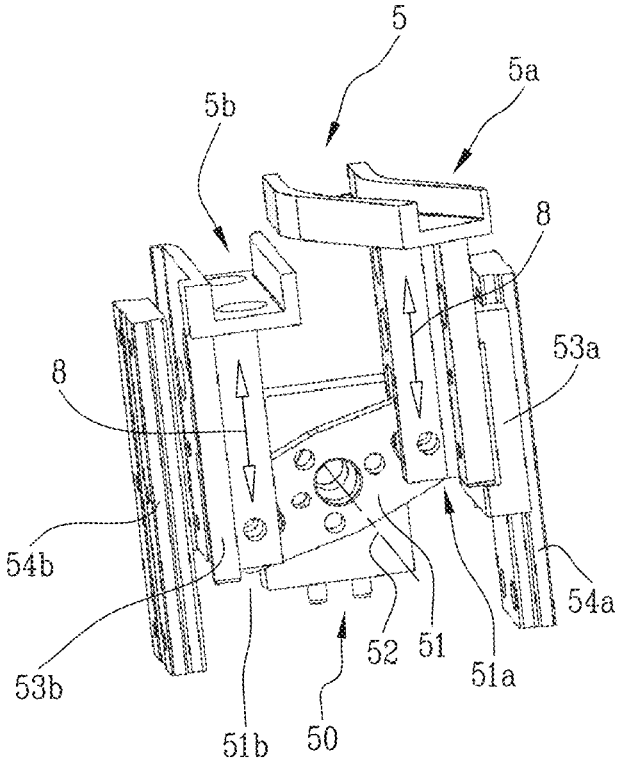
FIG. 4 is a schematic perspective view of a diverting unit of the apparatus of FIG. 2.

More specifically, in the embodiment of the diverting unit 5 illustrated in FIG. 4, when the first diverting rail 5*a* is translated vertically upwards, towards the first configuration, the second diverting rail 5*b* is simultaneously translated vertically downwards, towards the second, rest configuration.

Preferably, the switching means comprise a first slide 53*a* and a second slide 53*b* interposed, respectively, between the rocker 51 and the first diverting rail 5*a* and between the rocker 51 and the second diverting rail 5*b*.

The first slide 53*a* and the second slide 53*b* are slidably movable in a first guide 54*a* and in a second guide 54*b*, respectively.

This invention achieves the preset aims, overcoming the disadvantages of the prior art, by providing the user with an apparatus for packing products 3 in cartons 2 which is both effective and efficient and capable of increasing production rates and reducing maintenance.

The invention claimed is:

1. An apparatus for packing products in cartons, comprising:

a first feed line for feeding cartons used to pack the products, a second feed line for feeding products, synchronized with the first feed line in such a way that the products are inserted into the cartons, a plurality of pushing elements movable one after the other in synchrony with the first and second feed lines, a diverting unit adapted to operate on the pushing elements in transit and switchable between a first configuration, in which the diverting unit directs the pushing elements along an active path where one of the pushing elements is driven to push one of the products into a respective one of the cartons, and a second configuration in which the diverting unit directs the pushing elements along an inactive path, detecting means for detecting parameters identifying a presence of the one of the cartons and/or of the one of the products on which the one of the pushing elements operates, the detecting means comprising at least one detecting sensor, switching means connected to the detecting means and configured to switch the diverting unit to the first configuration or to the second configuration as a function of the identification parameters;

each of the pushing elements comprising a first carriage configured to run on a first rail defining the active path and a second carriage configured to run on a second rail defining the inactive path, the diverting unit comprises a first diverting rail and a second diverting rail adapted, respectively, to receive the first carriage of the pushing element in the first configuration and the second carriage of the pushing element in the second configuration, the first diverting rail defining a first stretch of the first rail in the first configuration and the second diverting rail defining a second stretch of the second rail in the second configuration.

2. The apparatus according to claim 1, wherein the first diverting rail and the second diverting rail are reciprocatingly movable towards and away from the first rail and the second rail in a normal direction.

3. The apparatus according to claim 2, wherein the switching means comprises a rocker alternately rotatable about an axis of rotation, the first diverting rail being operatively connected with a first free end of the rocker and the second diverting rail being operatively connected with a second free end of the rocker.

4. The apparatus according to claim 3, wherein the switching means comprises a first slide and a second slide interposed, respectively, between the rocker and the first diverting rail and between the rocker and the second diverting rail, the first slide and the second slide being slidably movable in a first guide and in a second guide, respectively.

5. The apparatus according to claim 1, wherein the first carriage and the second carriage are disposed on an underside of the each of the pushing elements element and are defined by a first roller and a second roller, respectively, each of the first and second rollers having an increased compliance sliding portion located at a distal position relative to the underside of the each of the pushing elements and adapted to slide in the first rail and in the second rail, respectively.

* * * * *